US008695184B1

(12) United States Patent
Mikat

(10) Patent No.: US 8,695,184 B1
(45) Date of Patent: Apr. 15, 2014

(54) METHOD AND APPARATUS FOR PRESERVING HUMAN AND ANIMAL REMAINS

(71) Applicant: Kurt Mikat, Windermere, FL (US)

(72) Inventor: Kurt Mikat, Windermere, FL (US)

( * ) Notice: Subject to any disclaimer, the term of this patent is extended or adjusted under 35 U.S.C. 154(b) by 0 days.

(21) Appl. No.: 13/705,394

(22) Filed: Dec. 5, 2012

(51) Int. Cl.
*A61G 17/00* (2006.01)

(52) U.S. Cl.
USPC ..... 27/11

(58) Field of Classification Search
USPC ..... 27/11, 2; 52/129–132; 62/78
See application file for complete search history.

(56) References Cited

U.S. PATENT DOCUMENTS

| | | | | | |
|---|---|---|---|---|---|
| 1,431,727 | A | * | 10/1922 | Dunn | 27/2 |
| 1,637,271 | A | * | 7/1927 | Niemeyer | 27/6 |
| 2,247,617 | A | | 7/1941 | Metz | |
| 2,296,539 | A | | 9/1942 | Salle | |
| 2,516,488 | A | | 7/1950 | Smith | |
| 2,674,102 | A | * | 4/1954 | Stile | 62/256 |
| 3,681,820 | A | | 8/1972 | Jalbert | |
| 3,898,718 | A | | 8/1975 | Eubanks | |
| 3,938,287 | A | * | 2/1976 | Gauchard | 52/134 |
| 4,067,091 | A | | 1/1978 | Backman | |
| 4,879,789 | A | * | 11/1989 | Bak | 27/11 |
| 4,924,565 | A | | 5/1990 | Rathjen | |
| 5,568,677 | A | | 10/1996 | Tobin | |
| 5,659,932 | A | | 8/1997 | Wright | |
| 5,715,583 | A | | 2/1998 | Sandoval | |
| 5,924,181 | A | * | 7/1999 | Takasugi | 27/11 |
| 7,703,186 | B1 | | 4/2010 | Williamson | |
| 2008/0307822 | A1 | * | 12/2008 | Richardson | 62/376 |

* cited by examiner

*Primary Examiner* — William Miller
(74) *Attorney, Agent, or Firm* — Kelly G. Swartz

(57) ABSTRACT

An apparatus for preserving human or animal remains comprising a burial chamber further comprising a hermetically sealed interior containing gas or water vapor, wherein the gas creates a gas pressure within the hermetically sealed interior, and a vacuum pump, wherein the vacuum pump is in functional communication with the hermetically sealed interior, wherein the vacuum pump operates to evacuate the gas or the water vapor from the hermetically sealed interior, and wherein the vacuum pump is intermittently activated to reduce the gas pressure within the hermetically sealed interior for a desiccating duration.

14 Claims, 1 Drawing Sheet

METHOD AND APPARATUS FOR PRESERVING HUMAN AND ANIMAL REMAINS

FIELD OF THE INVENTION

The present invention relates to the field of undertaking. More specifically, the present invention relates to an apparatus and method that allows remains to be preserved indefinitely without requiring the use of embalming agents.

BACKGROUND OF THE INVENTION

Since the beginning of time men have endeavored to design and construct a repository, such as coffins and vaults, wherein the bodies of their deceased loved ones would be preserved and protected from the ravages of decay and decomposition forever. That ultimate goal has never been attained. To the contrary, it is an established fact that all human and/or animal corpses commence to decay and decompose immediately after death occurs A recently published German newspaper article clearly attests to this corpse decay factor, and also provides data pertaining to the approximate rate of that decomposition. This item was published by the Deutsche Presse Agentur News Agency in March, 1994. It was re-published in the Mobile Press Register newspaper on Nov. 5, 1994. This article states, in its entirety, as follows:

> "The Deutsche Presse Agentur News Agency reported in March that German cemetery operators are worried about the increasing resilience of embalmed bodies. Because of the country's land shortage, burial plots are often only rented out for 15 year periods, with the hope that the bodies will have decomposed by that time, and that families will not object to their disposal. Cemetery owners are now avoiding certain soils that retard air and moisture circulation, because they restrict the growth of bacteria that eat the bodies."

Prior art coffins do not provide any significant protection from decay and decomposition. Most of the available units are very ornate and extremely expensive. There are no coffins in today's marketplace, i.e., funeral homes and mortuaries, which have been specifically designed or constructed to provide long time protection of the corpse. This fact has caused extreme distress, or serious psychological problems, to untold thousands of family member survivors throughout the world.

Several prior art coffins have been patented wherein the inventors have claimed that their coffin/casket was "air tight" or "gas tight". Each such invention typically described an extremely complicated, albeit impossible to attain method for the mating and sealing of two or more segments. Each of these units also required an intricate set of complex valves for the cited purposes of withdrawing air from within the sealed coffin, and the injection of some type of unidentified gas thereinto. All of these types of coffins/caskets have been proven to be totally inadequate and ineffective, as evidenced by their complete absence from today's marketplace.

Smith (U.S. Pat. No. 2,516,488) teaches a casket which requires two (2) each complex valves (FIGS. 8 and 9) being mounted, in a through-wall manner, onto his casket. Smith further requires that the casket body member 1 be covered with a lid 4, with an "asbestos or other gasket 5" being interposed between said lid and body, and that the lid be secured to the casket body by means of twenty-two (22) bolts 12 (FIG. 1). The total failure of Smith's teaching is abundantly clear by the fact that said gasket material would have to be approximately sixteen (16) feet long to extend around the circumference distance of said casket. Whereas, the introduction of just one (1) single, infinite size cut, nick, break, or any other type of discontinuity within said gasket material, would ultimately result in the total loss of his required internal protective atmosphere. The probability that such a discontinuity will occur under the given parameters is clearly astronomical, or inevitable.

Eubanks (U.S. Pat. No. 3,898,718) teaches "a corpse container 15 comprising a high density outer skin 47 that is unitary with a foamed interior-being sealable about a corpse—and extending to meet and mate with the opposite half—to seal said corpse container." (claim 1.e) Therewith, Eubanks clearly cites his intentions that the corpse become an integral part within the unitary, i.e., indivisible whole, of the corpse container 15 and the foamed plastic 49 within the outer skin 47. Eubanks reveals his intentions very clearly in his FIGS. 4 and 5. As is clearly evidenced therein, the interior of his corpse container is filled to capacity with the described enclosed materials. By virtue thereof, it is abundantly clear that there is no space whatever available within his corpse container for either a gaseous material, nor for any type of valve mechanism type of device.

Jalbert (U.S. Pat. No. 3,681,820) teaches "a burial system for vertically burying—of human remains—including a unique frusto-conical, completely sealed casket made of plastic." The casket 6 includes a frusto-conical hollow body 70, with the large diameter, or "head end" of the casket body to be closed by means of a "circular cap 98", and the smaller diameter end to be closed by an "end cap 114." The corpse bearing casket 6 is required to be inserted into a prepared frusto-conical chamber 4, located within a burial vault 2, which was previously installed in a selected cemetery burial plot. Conspicuously absent from this invention is any type of provision for the evacuation of entrapped gases from within the casket.

As illustrated above, it is exceedingly clear that it would so not be obvious, nor physically possible for anyone skilled in the art to successfully utilize the valves taught by Smith, or by any other inventor, within the confines of the coffin taught by Eubanks to achieve indefinite preservation of human or animal remains. These prior art references do not contain any suggestion, either express or implied, that they may be combined in any manner whatever.

Some inventions patented in foreign countries have also taught similar types of un-workable and unsuccessful ideas pertaining to coffins. Becker (England-No. 17,056-A.D. 1910) taught a coffin "provided with a bottle of preservative in order that decomposition of the corpse may be arrested." His teaching was to merely insert a small vial of some unidentified type of chemical compound within his coffin. He did not cite any concern nor procedure for the removal of any of the critical, decay causing atmospheric elements trapped therein.

Pothier (France-No. 3,435,494) taught a coffin "constructed of metal designed to reduce or eliminate the evolution of decomposition gasses and, on the other hand, to permit the evacuation of gasses of this type which may be evolved in spite of the arrangements made." He appears to have copied the Becker idea, and placed therein—"a closed cartridge, containing a substance which is capable of giving off a gas, other than oxygen, and means operable from the exterior, for initiating the opening of the cartridge." Pothier, like Becker, gave absolutely no thought whatever to the removal of any of the critical, decay causing, atmospheric elements entrapped within his sealed coffin.

All of the above cited patents, in addition to numerous other unidentified patents not mentioned herein, for caskets, coffins, and similar type burial containers, all suffer from a number of major disadvantages. Most specifically, the prior art patents fail to preserve the physical form, appearance, or condition of deceased animals and humans.

SUMMARY OF THE INVENTION

With the foregoing in mind, embodiments of the present invention are related to an apparatus and method for indefinitely preserving human or animal remains. Furthermore, the apparatus and method may advantageously combine removal of gas or water vapor from a burial chamber with a vacuum pump in association with a temperature control element that will enhance the process of desiccation and allow for preservation of the human or animal remains even in the event that the hermetic seal of the burial chamber is breeched at some future point.

According to an embodiment of the present invention, a burial chamber may be constructed to prevent environmental elements from entering or escaping from the burial chamber after the burial chamber is sealed. The hermetic seal of the burial chamber may only be broken by the connection to a vacuum pump. When the vacuum pump is activated, environmental elements, such as gas and water vapor, may be evacuated from the interior of the burial chamber.

When the vacuum pump exhausts gas from the interior of the burial chamber, the gas pressure within the burial chamber decreases. This reduction in gas pressure may promote desiccation of the human or animal remains contained within the burial chamber. And the resulting reduction in the moisture content of the human or animal remains will retard decomposition of those human or animal remains. Water vapor that is introduced into the interior of the burial chamber as a result of the desiccation process may be exhausted through use of the vacuum pump. By fully desiccating the remains before decomposition can ravage the remains, the remains can be preserved indefinitely.

When the vacuum pump is not operating or not activated, the hermetic seal of the burial chamber may prevent gas, moisture, or other environmental elements from entering or re-entering the burial chamber.

Some embodiments of the present invention may include a moisture sensor or a gas pressure sensor. To preserve the life of the vacuum pump or to reduce operating costs, the vacuum pump may only operate when conditions within the burial chamber indicate that the preservation of the human or animal remains would benefit from evacuating gas or water vapor from within the burial chamber. In some embodiments, the vacuum pump may only operate when the gas pressure or water vapor concentration in the burial chamber elevates above a specific threshold level.

In one possible embodiment of present invention the vacuum pump may be configured to run either intermittently, periodically, or continuously for only as long as necessary to ensure that the human or animal remains are adequately preserved. This duration may be less than indefinite and may be termed the desiccating duration. In embodiments in which the vacuum pump may not operate past the desiccating duration, the desiccating duration may be predetermined or may be determined based on the conditions within the burial chamber at some point after desiccation has commenced.

One possible embodiment of the present invention may include a temperature control element. The temperature control element may raise or lower the temperature of the interior of the burial chamber. In embodiments in which the temperature control element lowers the temperature of the interior, the process of decomposition may be retarded. In embodiments in which the temperature control element raises the temperature within the interior, the elevated temperature may assist the desiccation process and shorten the total desiccation duration. Some embodiments of the present invention may combine lowering the temperature to preserve the human or animal remains before the desiccation process begins or in the early stages of the process with raising the temperature to aid in the desiccation process.

In one embodiment of the present invention, all components of the apparatus are contained within the burial chamber. A power source may be included in the burial chamber to create a self-contained apparatus.

In embodiments in which the vacuum pump is contained within the burial chamber, the vacuum pump may exhaust to an area separate from the hermetically sealed interior of the burial chamber. This exhaust area may be separate from the apparatus for preserving human or animal remains or it may be a partition of the apparatus for preserving human or animal remains. A hermetic seal may be placed between the interior of the burial chamber and the exhaust area to allow water vapor or gas to be evacuated from the hermetically sealed interior but prevent water vapor, gas, or other environmental elements from entering the interior.

In one embodiment of the inventive method human or animal remains may be preserved by interring the remains in a hermetically sealed burial chamber. A vacuum pump may be in functional communication with the hermetically sealed interior of the burial chamber and the vacuum pump may be activated to evacuate gas or water vapor from the interior of the burial chamber. The vacuum pump may operate continuously, periodically, or intermittently during the desiccating duration to reduce the gas pressure within the hermetically sealed interior or remove water vapor from the hermetically sealed interior. A temperature control element may be activated to alter the temperature within the hermetically sealed interior of the burial chamber. The temperature control element may raise or lower the temperature within the hermetically sealed interior of the burial chamber.

The vacuum pump may be placed within the hermetically sealed interior of the burial chamber and configured to exhaust gas or water vapor through a hermetic seal to an area exterior to the hermetically sealed interior of the burial chamber.

In one embodiment of the inventive method, a power source may be placed within the hermetically sealed interior of the burial chamber. In yet another embodiment of the inventive method, the power source may by the sole power supply for the vacuum pump or the temperature control element. The vacuum pump may be activated only when the gas pressure or water vapor concentration within the hermetically sealed interior of the burial chamber exceeds a desiccating level.

By utilizing a vacuum pump to fully desiccate the human or animal remains contained within the burial chamber, the remains can be fully desiccated in a period of time short enough to prevent significant decomposition. After the desiccation process is completed, that is, after the desiccating duration, a loss of integrity to the hermetic seal of the burial chamber may have only minimal effect on the preservation of the human or animal remains. Because the human or animal remains will be essentially devoid of all moisture content, they will be impervious to the ravages of decomposition even in the event that ambient gases are allowed to reenter the burial chamber.

The inventive method may be practiced above ground or below ground. In one embodiment of the inventive method, the human or animal remains are interred and desiccation proceeds with the burial chamber above ground. At the conclusion of the desiccating duration, the human or animal remains may be buried underground. In another embodiment of the inventive method, the human or animal remains may be placed within a burial chamber along with any combination of a vacuum pump, a power source, and a temperature control element. The burial chamber may be buried or placed in its final resting position before the vacuum pump is activated and desiccation is commenced.

The inventive method may be practiced with or without the use of embalming agents.

DETAILED DESCRIPTION OF THE PREFERRED EMBODIMENT

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Figure 1:
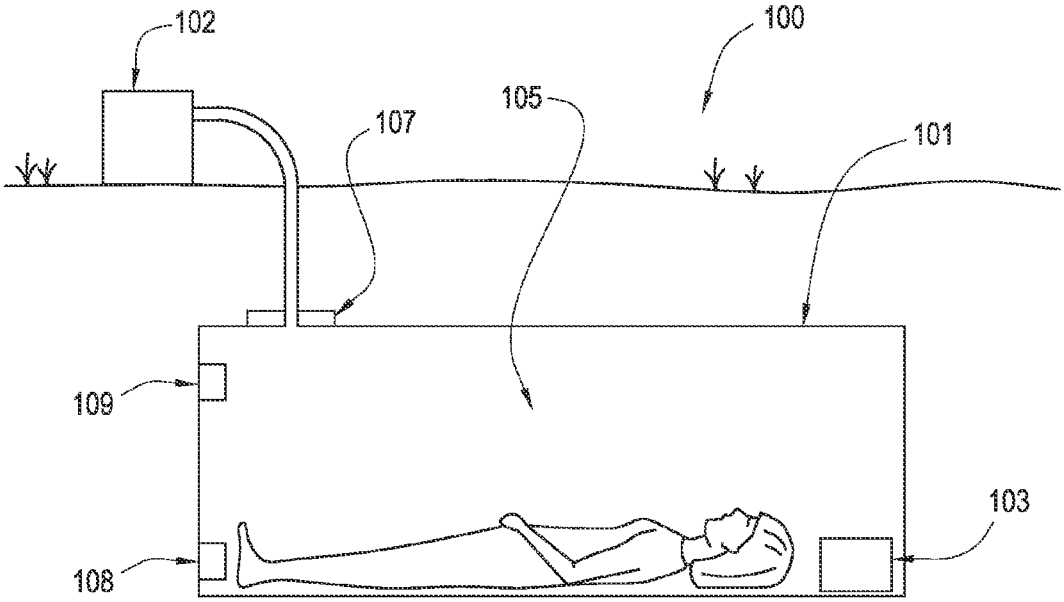
FIG. 1 is a cross section view illustrating one possible embodiment of the apparatus.

Referring now to FIG. 1, the apparatus is depicted with a burial chamber 101 shown below ground. While burial chambers 101 are often placed in the ground as a final resting place, as used in this document, the term burial chamber 101 includes all compartments that house human or animal remains for indefinite periods, whether the compartments are housed above ground or buried under ground. As examples and without the intent to be limiting, burial chambers 101 may include mausoleums as well as coffins, caskets, underground structures housing caskets, or the like. Those skilled in the art will recognize and appreciate that many kinds of containers may be recognized as burial chambers 101 within the scope of this invention.

As shown in FIG. 1, the burial chamber 101 may be hermetically sealed with the closure and sealing of the burial chamber 101 creating a hermetically sealed interior 105. The hermetically sealed interior 105 of the burial chamber 101 may contain gas or water vapor. Additionally, the hermetically sealed interior 105 may have an inherent gas pressure.

The apparatus for preserving human or animal remains 100 may include a vacuum pump 102 for regulating the gas pressure within the hermetically sealed interior 105. The burial chamber 101 may be constructed to prevent environmental elements from entering or escaping from the burial chamber 101 after the burial chamber 101 is sealed and when the vacuum pump 102 is not in use. A hermetic seal may be in functional communication between the vacuum pump 102 and the hermetically sealed interior 105. When the vacuum pump 102 is activated, environmental elements may escape from the hermetically sealed interior 105 through the hermetic seal 107. By way of example and not intended to be limiting, environmental elements may include air, various gases, or water vapor.

When the vacuum pump 102 is activated and gas, including air, is removed from the hermetically sealed interior 105, the gas pressure within the hermetically sealed interior 105 may be reduced. This reduction in gas pressure may promote desiccation of the human or animal remains 106 contained within the burial chamber 101. Reducing the moisture content of the human or animal remains 106 will retard decomposition of those human or animal remains 106. By fully desiccating the remains before decomposition can ravage the remains, the remains can be preserved indefinitely. Any water vapor introduced into the hermetically sealed interior 105 may be exhausted through the hermetic seal 107 by operation of the vacuum pump 102.

When the vacuum pump 102 is not operating or not activated, the hermetic seal 107 may prevent gas, moisture, or other environmental elements from entering or re-entering the burial chamber 101.

The apparatus for preserving human or animal remains 100 may also comprise a moisture sensor 108 or a gas pressure sensor 109. To preserve the life of the vacuum pump 102 or to reduce operating costs, the vacuum pump 102 may only operate when conditions within the burial chamber 101 indicate that the preservation of the human or animal remains 106 would benefit from evacuating gas or water vapor from the hermetically sealed interior 105. By way of example, but not as a limitation, the vacuum pump 102 may only operate when the gas pressure in the hermetically sealed interior 105 elevates above a specific threshold level. The gas pressure above which the vacuum pump 102 may activate may be termed the desiccating level. By way of another example, but not as a limitation, the vacuum pump 102 may only operate when the moisture content or water vapor within the burial chamber 101 elevates above a specific threshold level. The moisture content or ater vapor level above which the vacuum pump 102 may activate may be termed the desiccating level.

In one possible embodiment of the apparatus for preserving human or animal remains 100, the vacuum pump 102 may be configured to run either intermittently, periodically, or continuously for only as long as necessary to ensure that the human or animal remains 106 are adequately desiccated. This duration may be less than indefinite and may be termed the desiccating duration. In embodiments in which the vacuum pump 102 may not operate past the desiccating duration, the desiccating duration may be predetermined or may be determined based on the conditions within the burial chamber 101 at some point after desiccation has commenced.

One embodiment of the apparatus for preserving human or animal remains 100 may include a temperature control element 103. The temperature control element 103 may raise or lower the temperature of the hermetically sealed interior 105 of the burial chamber 101.

In one embodiment of the apparatus for preserving human or animal remains 100, the temperature control element 103 may lower the temperature of the hermetically sealed interior 105 of the burial chamber 101. By lowering the temperature at which the human or animal remains 106 are stored, the process of decomposition may be retarded. The human or animal remains 106 may be preserved by way of low temperatures within the hermetically sealed interior 105 for the desiccating duration. The human or animal remains 106 may be preserved by way of low temperatures within the hermetically sealed interior 105 prior to commencement of the desiccation process. Prior to, at the conclusion of, or at any point during the desiccating duration, the temperature within the interior 105 of the burial chamber 101 may return to ambient temperatures, the temperature control element 103 may be deactivated, the temperature control element 103 could be controlled to raise the temperature within the hermetically sealed interior 104, or the temperature could be altered in other ways.

In another embodiment of the apparatus for preserving human or animal remains 100, the temperature control element 103 may raise the temperature in the interior 105 of the burial chamber 101. Raising the temperature of the hermetically sealed interior 105 of the burial chamber 101 may assist the desiccation process and shorten the total desiccation duration. Therefore, the amount of time to which the human or animal remains 106 are subject to the forces of decomposition may be reduced and the preservation of the human or animal remains 106 may be enhanced.

Figure 2:
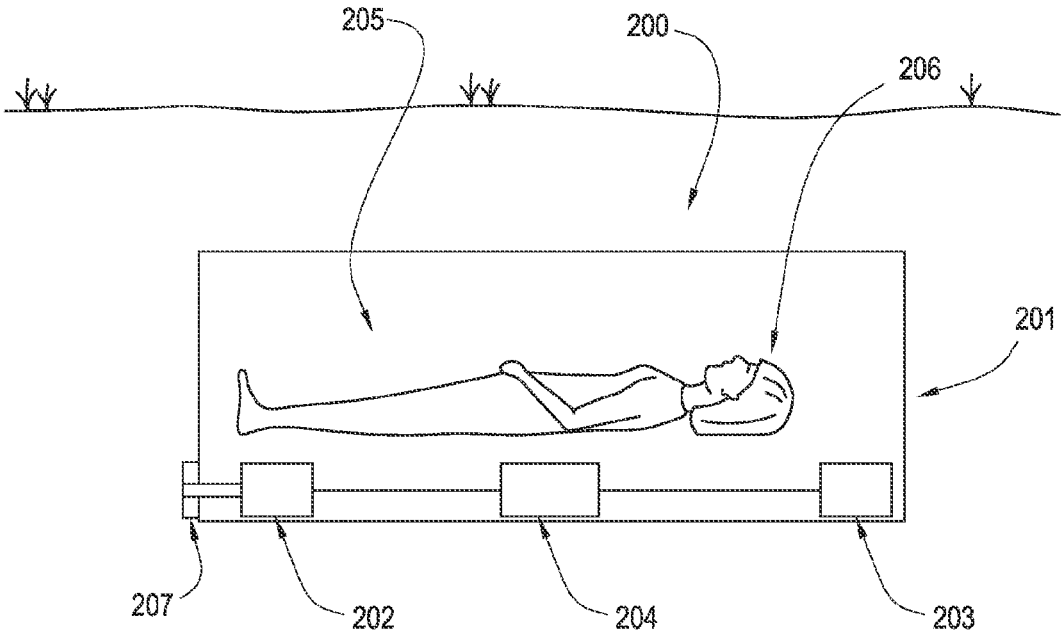
FIG. 2 is a cross section view illustrating another possible embodiment of the apparatus.

FIG. 2 shows an embodiment of the apparatus for preserving human or animal remains 200 in which all components of the apparatus are contained within the burial chamber 201. In the embodiment depicted in FIG. 2, a power source 204 is introduced within the burial chamber 201. Examples of this power source may include, but are not limited to a battery, generator, or other power source known in the art.

In some embodiments of the apparatus for preserving human or animal remains 200, the vacuum pump 202 may be placed within the burial chamber 201. In such an embodiment, the vacuum pump 202 may exhaust to an area separate from the hermetically sealed interior 205 of the burial chamber 201. This exhaust area may be separate from the apparatus for preserving human or animal remains 200 or it may be a partition of the apparatus for preserving human or animal remains 200. A hermetic seal 207 may be placed between the hermetically sealed interior 205 of the burial chamber 201 and the exhaust area to allow water vapor or gas to be evacuated from the hermetically sealed interior 205 but prevent water vapor, gas, or other environmental elements from entering the hermetically sealed interior 205.

In one embodiment of the inventive method according to the present invention, human or animal remains 206 may be preserved by interring the remains in a hermetically sealed burial chamber 201. A vacuum pump 202 may be in functional communication with the hermetically sealed interior 205 of the burial chamber 201 and may be activated to evacuate gas or water vapor from the hermetically sealed interior 205. The vacuum pump 202 may operate continuously, periodically, or intermittently during the desiccating duration to reduce the gas pressure within the hermetically sealed interior 205 or remove water vapor from the hermetically sealed interior 205. A temperature control element 203 may be activated to alter the temperature within the hermetically sealed interior 205 of the burial chamber 201. The temperature control element 203 may raise or lower the temperature within the hermetically sealed interior 205 of the burial chamber 201.

The vacuum pump 202 may be placed within the hermetically sealed interior 205 of the burial chamber 201 and configured to exhaust gas or water vapor through a hermetic seal 207 to an area exterior to the hermetically sealed interior 205 of the burial chamber 201. In one embodiment of the inventive method, a power source 204 may be placed within the hermetically sealed interior 205 of the burial chamber 201. In yet another embodiment of the inventive method, the power source 204 may by the sole power supply for the vacuum pump 202 or the temperature control element 203. The vacuum pump 202 may be activated only when the gas pressure within the hermetically sealed interior 205 of the burial chamber 201 exceeds a desiccating level. In some embodiments of the inventive method, the vacuum pump 202 may be activated only when the water vapor within the hermetically sealed interior 205 exceeds a certain concentration deemed a desiccating level.

By utilizing a vacuum pump 202 to fully desiccate the human or animal remains 206 contained within the hermetically sealed interior 205, the remains can be fully desiccated in a period of time short enough to prevent significant decomposition. After the desiccation process is completed, that is, after the desiccating duration, a loss of integrity to the hermetic seal 207 may have only minimal effect on the preservation of the human or animal remains 206. Because the human or animal remains 206 will be essentially devoid of all moisture content, they will be impervious to the ravages of decomposition even in the event that ambient gases are allowed to reenter the burial chamber 201.

The inventive method may be practiced above ground or below ground. In one embodiment of the inventive method, the human or animal remains 206 are interred and desiccation proceeds with the burial chamber 201 above ground. At the conclusion of the desiccating duration, the human or animal remains 206 may be buried underground. In another embodiment of the inventive method, the human or animal remains 206 may be placed within a burial chamber 201 along with any combination of a vacuum pump 202, a power source 204, and a temperature control element 203. The burial chamber 201 may be buried or placed in its final resting position before the vacuum pump 202 is activated and desiccation is commenced.

The inventive method may be practiced with or without the use of embalming agents.

A person of skill in the art will appreciate that one or more of the above provided embodiments may be included in the operation of the present invention. Additionally, a person of skill in the art will appreciate additional embodiments that would be included within the scope and spirit of the present invention, after having the benefit of this disclosure. Furthermore, a skilled artisan will appreciate that the operations described above, along with additional operations that would be apparent to those in the art, may be performed exclusively, incrementally, sequentially, simultaneously, or any other operative configuration.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

What is claimed is:

1. An apparatus for preserving human or animal remains comprising:

a burial chamber for housing a human or animal body comprising a hermetically sealed interior containing gas and water vapor, wherein the gas creates a gas pressure within the hermetically sealed interior;

a gas pressure sensor wherein the gas pressure sensor is capable of detecting the gas pressure;

a vacuum pump wherein the vacuum pump is in functional communication with the hermetically sealed interior; wherein the vacuum pump operates to evacuate the gas and the water vapor from the hermetically sealed interior; and wherein the vacuum pump is intermittently activated to reduce the gas pressure within the hermetically sealed interior for a desiccating duration; and wherein the vacuum pump is activated only when the gas pressure within the hermetically sealed interior exceeds a desiccating level.

2. The apparatus for preserving human or animal remains according to claim 1 further comprising a temperature control element.

3. A method for preserving human or animal remains, the method comprising:

interring a human or animal body in a burial chamber comprising a hermetically sealed interior containing gas and water vapor, wherein the gas creates a gas pressure within the hermetically sealed interior;

placing a gas pressure sensor in functional communication with the hermetically sealed interior;

placing a vacuum pump in functional communication with the hermetically sealed interior; and activating the vacuum pump;

wherein the vacuum pump operates to reduce the gas pressure within the hermetically sealed interior;

wherein the gas pressure sensor is capable of detecting a gas pressure;

wherein the vacuum pump is activated only when the gas pressure within the hermetically sealed interior exceeds a desiccating level;

wherein the vacuum pump operates to reduce the water vapor within the hermetically sealed interior; and wherein the vacuum pump is activated for a desiccating duration.

4. The method for preserving human or animal remains according to claim 3 further comprising the step of activating a temperature control element to increase the temperature within the hermetically sealed interior wherein the temperature alteration facilitates desiccation.

5. The method for preserving human or animal remains according to claim 3 further comprising the step of placing the vacuum pump within the hermetically sealed interior wherein the vacuum pump exhausts to the exterior of the hermetically sealed interior.

6. The method for preserving human or animal remains according to claim 3 further comprising the step of placing a power source within the hermetically sealed interior.

7. The method for preserving human or animal remains according to claim 6 wherein the vacuum pump is powered exclusively by the power source.

8. The method for preserving human or animal remains according to claim 3 further comprising the step of placing the burial chamber underground while the vacuum pump remains in functional communication with the hermetically sealed interior.

9. The method for preserving human or animal remains according to claim 3 further comprising the step of activating a temperature control element to alter the temperature within the hermetically sealed interior wherein the temperature alteration facilitates desiccation or impedes decomposition.

10. A method for preserving human or animal remains, the method comprising:

interring a human or animal body in a burial chamber comprising a hermetically sealed interior containing gas and water vapor, wherein the gas creates a gas pressure within the hermetically sealed interior;

connecting a vacuum pump to the hermetically sealed interior;

activating the vacuum pump;

placing a gas pressure sensor in functional communication with the hermetically sealed interior;

locating a temperature control element within the hermetically sealed interior;

activating the temperature control element wherein the temperature control element increases and decreases the temperature within the hermetically sealed interior, wherein the temperature alteration enhances desiccation or impedes decomposition;

wherein the vacuum pump operates to reduce the gas pressure within the hermetically sealed interior;

wherein the gas pressure sensor is capable of detecting a gas pressure;

wherein the vacuum pump is activated only when the gas pressure within the hermetically sealed interior exceeds a desiccating level;

wherein the vacuum pump operates to reduce the water vapor within the hermetically sealed interior; and wherein the reduced gas pressure within the hermetically sealed interior is maintained for a desiccating duration.

11. The method for preserving human or animal remains according to claim 10 further comprising the step of placing the vacuum pump within the hermetically sealed interior wherein the vacuum pump vents to the exterior of the hermetically sealed interior.

12. The method for preserving human or animal remains according to claim 11 further comprising the step of placing a power source within the hermetically sealed interior wherein the vacuum pump is powered exclusively by the power source.

13. The method for preserving human or animal remains according to claim 10 further comprising the step of placing the burial chamber underground.

14. The method for preserving human or animal remains according to claim 13 further comprising the step of injecting embalming agents into the human or animal body.

* * * * *